US009228365B2

(12) United States Patent
Moyher

(10) Patent No.: US 9,228,365 B2
(45) **Date of Patent: *Jan. 5, 2016**

(54) BRACKET ASSEMBLY AND FORM SIDE WALLS FOR FORMING CONCRETE STRUCTURAL COMPONENTS

(71) Applicant: Charles S. Moyher, Milford, CT (US)

(72) Inventor: Charles S. Moyher, Milford, CT (US)

(73) Assignee: Charles S. Moyher, Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/371,646

(22) PCT Filed: Jan. 10, 2013

(86) PCT No.: PCT/US2013/021081

§ 371 (c)(1),
(2) Date: Jul. 10, 2014

(87) PCT Pub. No.: WO2013/106604

PCT Pub. Date: Jul. 18, 2013

(65) Prior Publication Data

US 2014/0353465 A1 Dec. 4, 2014

Related U.S. Application Data

(63) Continuation of application No. 13/374,724, filed on Jan. 10, 2012, now Pat. No. 8,627,615.

(51) Int. Cl.
*E02D 19/00* (2006.01)
*E04G 9/10* (2006.01)
(Continued)

(52) U.S. Cl.
CPC ..... *E04G 21/06* (2013.01); *E02D 19/00* (2013.01); *E02D 27/02* (2013.01); *E04G 9/10* (2013.01); *E04G 11/06* (2013.01); *E04G 13/00* (2013.01)

(58) Field of Classification Search
CPC ..... E04B 1/70; E04B 1/7061; E04B 1/703; E04B 1/7023; E02D 31/02
USPC ..... 52/169.5; 249/3, 4, 5, 34, 216, 218
See application file for complete search history.

(56) References Cited

U.S. PATENT DOCUMENTS 1,527,551 A 2/1925 Hollis
1,564,982 A 12/1925 Smith
(Continued)

OTHER PUBLICATIONS

International Preliminary Report on Patentability for International Application No. PCT/US13/21081, dated Feb. 10, 2014.
(Continued)

*Primary Examiner* — Michael Safavi
(74) *Attorney, Agent, or Firm* — MKG LLC

(57) ABSTRACT

A system is provided for retaining a flowable and curable building material to form a portion of a foundation of a structure of interest. A first and second side wall receive and retain the building material in a channel bound by the side walls. At least one of the side walls defines an interior cavity. A venting conduit is disposed within the structure of interest and coupled to the interior cavity to form a first passage. A bracket assembly retains the side walls in the predetermined configuration and includes two or more reinforcement posts and a separator bar. The separator bar has a first and second set of apertures proximate a first and second end that are sized to receive and retain a pair of the reinforcement posts at locations to establish a width of the components of the side walls and the channel being formed therebetween.

20 Claims, 18 Drawing Sheets

(51) Int. Cl.

| | |
|---|---|
| ***E04G 11/06*** | (2006.01) |
| ***E04G 21/06*** | (2006.01) |
| ***E02D 27/02*** | (2006.01) |
| ***E04G 13/00*** | (2006.01) |

(56) References Cited

U.S. PATENT DOCUMENTS

| | | | |
|---|---|---|---|
| 1,702,671 | A | 2/1929 | Toogood |
| 1,729,807 | A | 10/1929 | Toogood |
| 1,755,960 | A | 4/1930 | Kohler |
| 1,800,802 | A | 4/1931 | Miller |
| 1,924,631 | A | 8/1933 | Toogood |
| 2,289,819 | A | 7/1942 | Wirtane |
| 3,374,984 | A | 3/1968 | Mueller |
| 3,578,777 | A | 5/1971 | DeGain |
| 3,778,019 | A | 12/1973 | Stegmeier |
| 4,202,145 | A | 5/1980 | Coutler et al. |
| 4,528,787 | A | 7/1985 | Rittinge |
| 4,830,543 | A | 5/1989 | Joubert |
| 4,865,362 | A | 9/1989 | Holden |
| 5,015,117 | A | 5/1991 | Pawlicki |
| 5,120,162 | A | 6/1992 | Parker |
| 5,224,799 | A | 7/1993 | Parker |
| 5,277,003 | A | 1/1994 | Myers |
| 5,399,050 | A | 3/1995 | Jacobus |
| 5,444,950 | A | 8/1995 | Kelly et al. |
| 5,466,092 | A | 11/1995 | Semenza et al. |
| 5,474,400 | A | 12/1995 | Kliefoth et al. |
| 5,564,235 | A | 10/1996 | Butler |
| 5,884,439 | A | 3/1999 | Hess, III et al. |
| 6,223,777 | B1 | 5/2001 | Smith et al. |
| D443,344 | S | 6/2001 | Evans |
| 6,619,001 | B1 | 9/2003 | Pratt |
| 6,629,681 | B1 | 10/2003 | Miller et al. |
| 6,634,144 | B1 | 10/2003 | Moore et al. |
| 6,742,758 | B2 | 6/2004 | Janesky |
| 7,017,614 | B2 | 3/2006 | Handley |
| 7,866,097 | B1 | 1/2011 | Moyher |
| 7,886,774 | B1 | 2/2011 | Popp |
| 8,627,615 | B2 | 1/2014 | Moyher |
| 2003/0059258 | A1 | 3/2003 | Lee et al. |
| 2003/0101670 | A1 | 6/2003 | Gustin |
| 2003/0146365 | A1 | 8/2003 | Miller et al. |
| 2006/0188336 | A1 | 8/2006 | Huber |
| 2007/0045491 | A1 | 3/2007 | Spencer et al. |
| 2009/0000682 | A1 | 1/2009 | Kisu et al. |

OTHER PUBLICATIONS

International Search Report for International Application No. PCT/US13/21081, dated Apr. 5, 2013.

Written Opinion for International Application No. PCT/US13/21081, dated Mar. 10, 2013.

BRACKET ASSEMBLY AND FORM SIDE WALLS FOR FORMING CONCRETE STRUCTURAL COMPONENTS

BACKGROUND OF THE INVENTION

1. Field of the Invention

This invention relates generally to a bracket assembly and a form system used to build structural components and, more specifically, to a bracket assembly and a form system used to build structural components such as, for example, a foundation for a building, from a volume of concrete and/or other at least partially liquid and curable building material.

2. Description of Related Art

As noted in the above-identified commonly owned U.S. Pat. No. 7,866,097, conventional form systems are known to receive and to maintain a volume of concrete and/or other at least partially liquid building materials in place while the building materials cure over time. Once cured, the form system is typically removed from the cured building material to expose the formed structural component for use as, for example, a foundation or portion thereof, supporting a building or like structure of interest.

As is generally known in the art of building construction, an area is excavated and a form system is assembled therein to match dimensions of a desired foundation or footing. Conventional forms typically comprise panels constructed of steel, wooden boards, planks or sheet material (e.g., plywood) and the like, that are arranged in parallel side-by-side configurations to define side walls and a channel between the side walls along one or more lengths of the excavated area. The panels are staked or otherwise secured in place to prohibit deformation of the side walls as concrete is poured in the channel between the side walls. As can be appreciated, dimensions (e.g., height, thickness, length and shape) of foundations and footings (and thus the form system) vary depending on the structure being built as well as applicable building codes and standards of the industry.

Accordingly, while some aspects of conventional forms and components thereof can be standardized, some degree of customization is typically needed to meet the requirements of the structure being built and/or the building codes and standards employed at the particular job site. In view thereof, the inventor has recognized that a need exists for a relatively inexpensive and easily configured bracket assembly and form system to build structural components such as, for example, a foundation for a building or portions thereof.

SUMMARY OF THE INVENTION

The present invention resides in one aspect in a system for retaining a flowable and curable building material to form a portion of a foundation of at least a portion of a structure of interest. The system comprises side walls that receive and retain the building materials and a bracket assembly to retain the side walls in a predetermined configuration suitable for the portion of the foundation. The side walls include a first side wall and a second side wall, and at least one of the first side wall and the second side wall is comprised of a component having an interior cavity. In one embodiment, the component is a pipe or a rectangular conduit. The bracket assembly includes two or more reinforcement posts and a separator bar. The separator bar has a first end, a second end opposed from the first end, and a plurality of apertures disposed along a length of the separator bar. The plurality of apertures including a first set of apertures disposed proximate the first end and a second set of apertures disposed proximate the second end.

The first set apertures and the second set of apertures are sized to receive and retain each of the reinforcement posts at locations corresponding to nominal widths of the component and building materials used to construct the same.

In one embodiment, the predetermined configuration is constructed by interconnecting two or more of the components to form the side walls and by retaining the two or more components with a plurality of the bracket assemblies to form a cross section approximating one of a rectangle, a trapezoid or combinations thereof.

In one embodiment, respective interior cavities of the interconnected components form a passage and the system further comprises a conduit disposed about the structure of interest and coupled to at least one of the components. The conduit has an interior cavity that communicates with the passage to vent gas from the passage to the atmosphere outside of the structure of interest.

BRIEF DESCRIPTION OF THE DRAWINGS

In these figures like structures are assigned like reference numerals, but may not be referenced in the description of all figures.

DETAILED DESCRIPTION OF PREFERRED EMBODIMENTS

Figure 1:
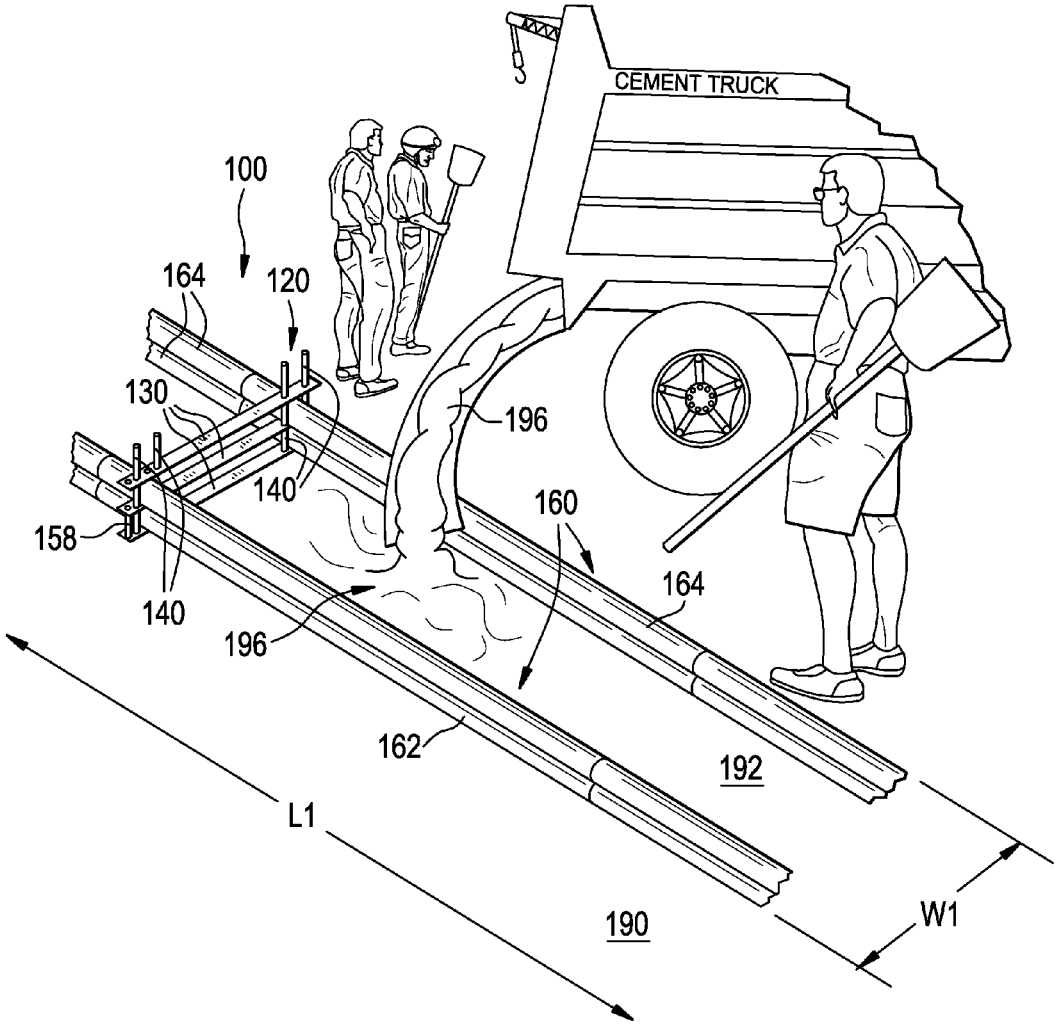
FIG. 1 is a perspective view of an inventive form system in accordance with one embodiment of the present invention.

As shown in FIG. 1, in one embodiment an inventive form system 100 includes a bracket assembly 120 configured and operating to retain side walls 160 (e.g., a first side wall 162 and a second side wall 164) in a spaced relation apart from one another over a predetermined configuration (e.g., height H1, width W1, length L1 and shape S1) within an excavated area 190. For example, the bracket assembly 120 retains the first side wall 162 at a configuration that includes a position parallel to and horizontally spaced apart from (e.g., distant from) the second side wall 164 along at least a portion of the length L1 of and/or partially within the excavated area 190. As shown in FIG. 1, the bracket assembly 120 and side walls 160 cooperate to define a channel 192 that receives and retains a flowable and at least partially liquid building material 196 such as, for example, concrete, poured into the channel 192. As described herein, the channel 192 is configured to be of a predetermined configuration (e.g., height H1, width W1, length L1 and shape) suitable for a footing and/or wall of a foundation supporting a structure of interest, or portion thereof.

Figure 2:
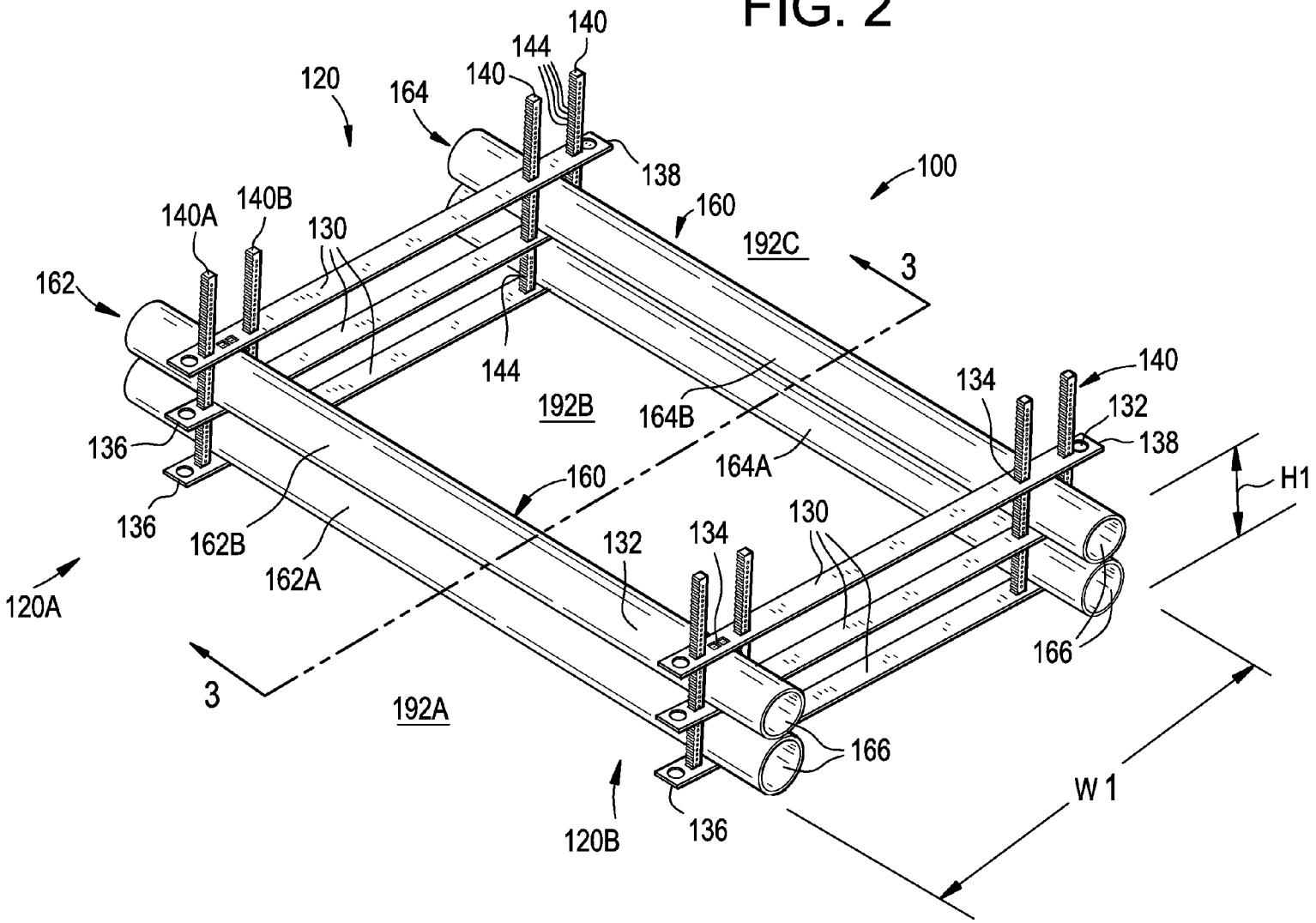
FIG. 2 is a perspective view of components of the form system in accordance with one embodiment of the present invention.
Figure 3:
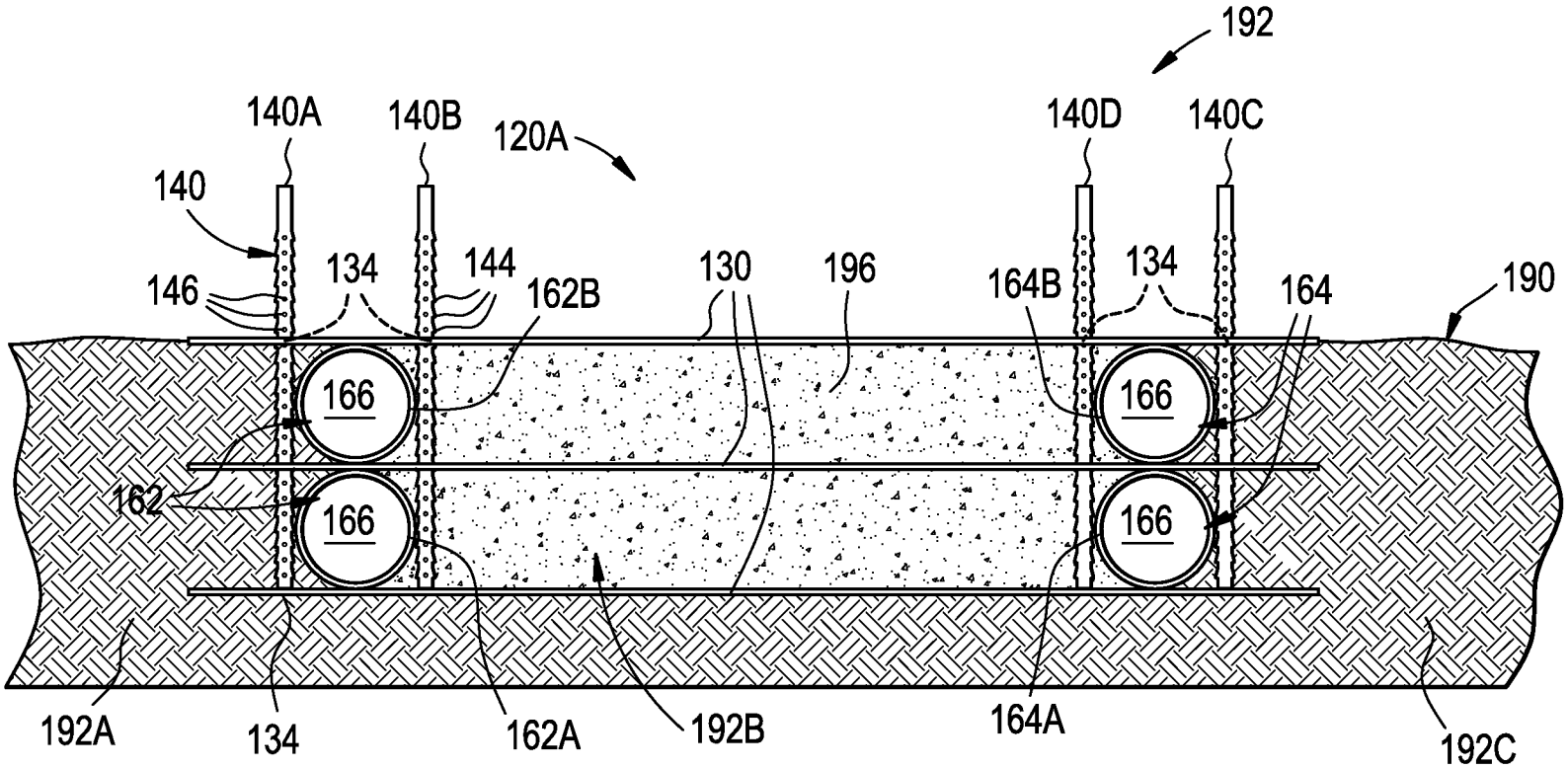
FIG. 3 is a cross-sectional view of the components of FIG. 2, taken along line 3-3.
Figure 4:
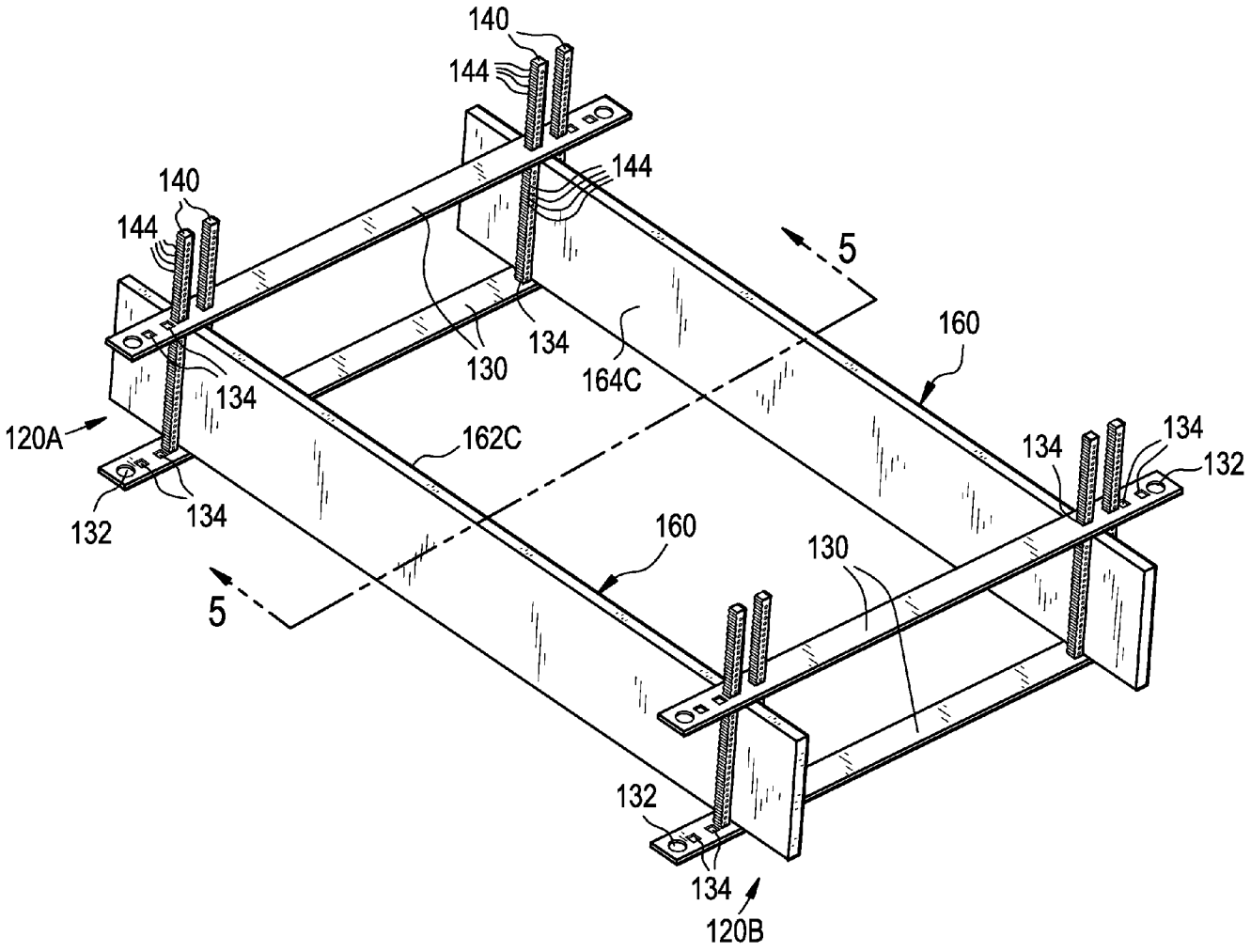
FIG. 4 is a perspective view of components of the form system in accordance with one embodiment of the present invention.
Figure 5:
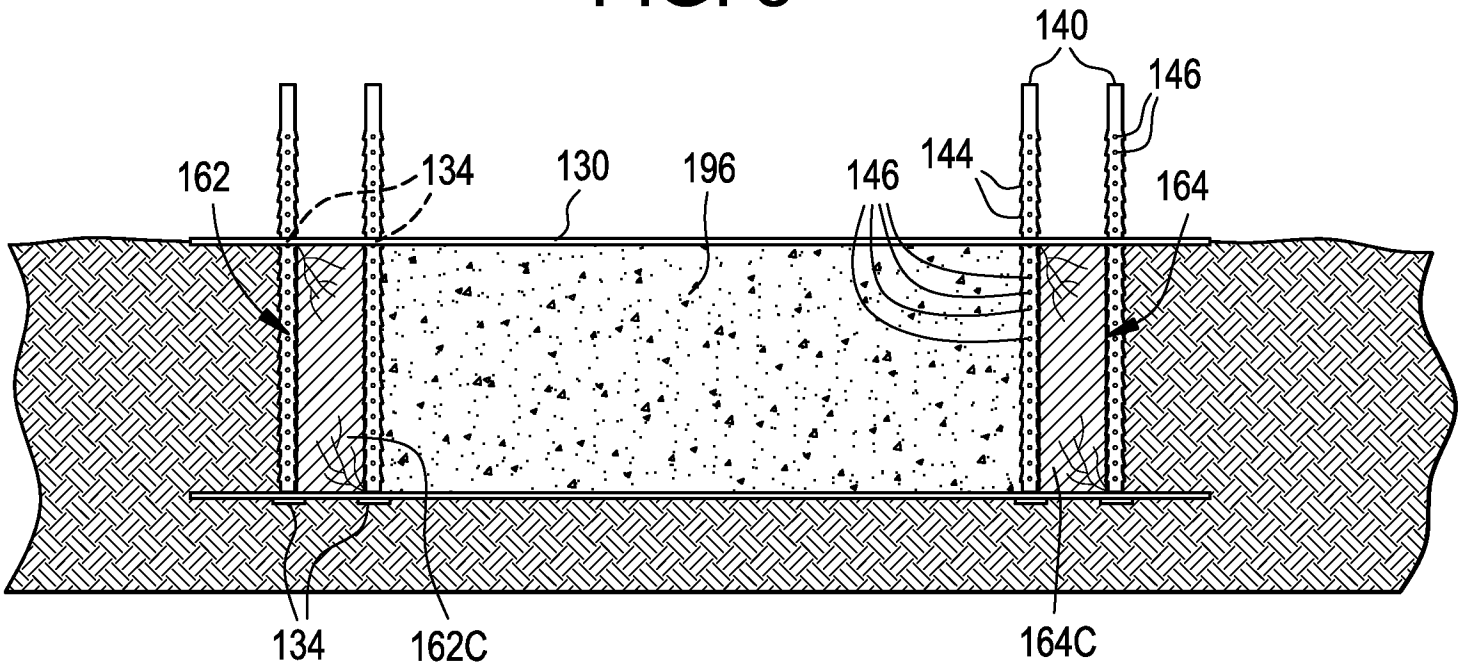
FIG. 5 is a cross-sectional view of the components of FIG. 4, taken along line 5-5.
Figure 6:
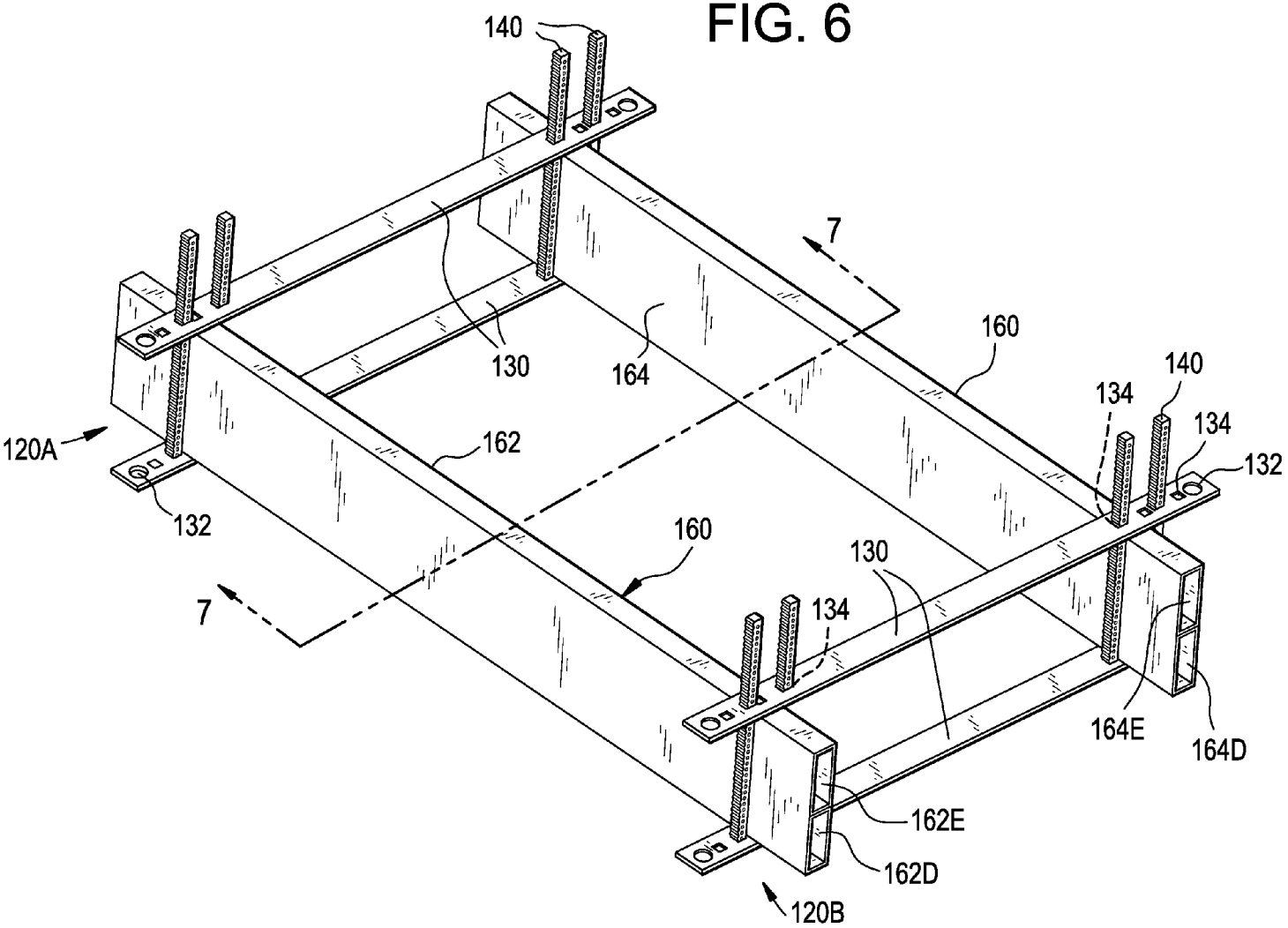
FIG. 6 is a perspective view of components of the form system in accordance with one embodiment of the present invention.
Figure 7:
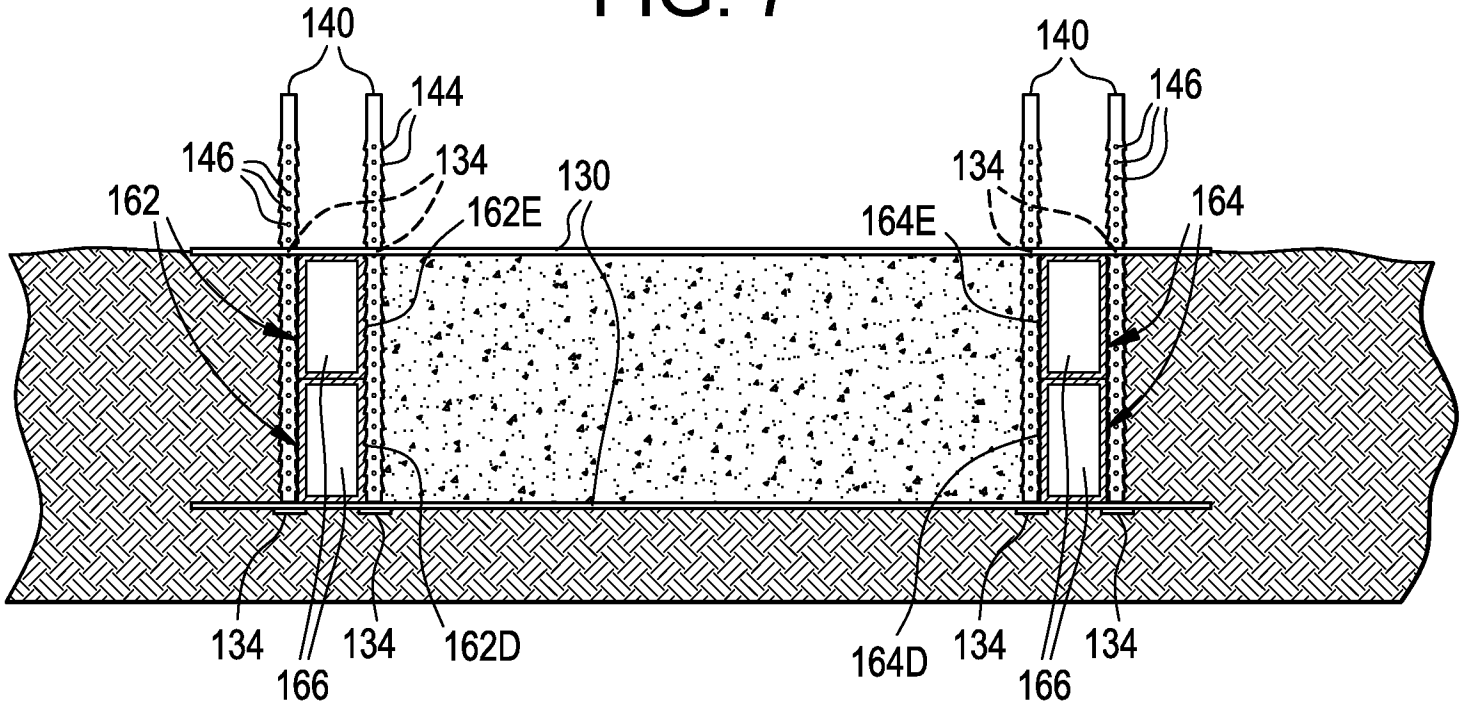
FIG. 7 is a cross-sectional view of the components of FIG. 6, taken along line 7-7.

It should be appreciated that while FIG. 1 illustrates only one bracket assembly 120 retaining the side walls 160, it is within the scope of the present invention to employ one or more bracket assemblies 120 at varying intervals along the length L1 of and/or the configuration within the excavated area 190 to keep the side walls 160 from moving (e.g., being displaced) by pressure exerted thereon by the flowing concrete 190 introduced to the channel 192. It should also be appreciated that the side walls 160 may be constructed from one single, or two or more stacked components as needed to form the predetermined configuration. The components include a section or sections (e.g., pieces) of elongated building materials such as, for example, wooden boards, planks or sheet materials such as plywood, tubular members such as round drain or drainage pipe, square or rectangular pipe or conduit, and the like, and combinations thereof. For example, FIGS. 2 and 3 illustrate two bracket assemblies 120A and 120B disposed at opposite ends and coupling components of the two side walls 162 and 164 within the configuration, or portion thereof. As shown in FIGS. 2 and 3, two stacked sections of elongated building material, for example, drain pipe 162A and 162B, comprising the first side wall 162, are retained in a vertically stacked orientation and a horizontally distant relation from two stacked sections of drain pipes 164A and 164B, comprising the second wall 164 of the configuration. FIGS. 4 and 5 illustrate two bracket assemblies 120A and 120B disposed at opposite ends and retaining pieces of elongated wooden planks 162C and 164C, comprising the first side wall 162 and the second side wall 164, in a vertical orientation and horizontally distant relation. FIGS. 6 and 7 illustrate two bracket assemblies 120A and 120B disposed at opposite ends and retaining two pieces of elongated rectangular conduit 162D and 162E of the first side wall 162 in a vertically stacked orientation and a horizontally distant relation from two pieces of elongated rectangular conduit 164D and 164E of the second wall 164.

Figure 8:
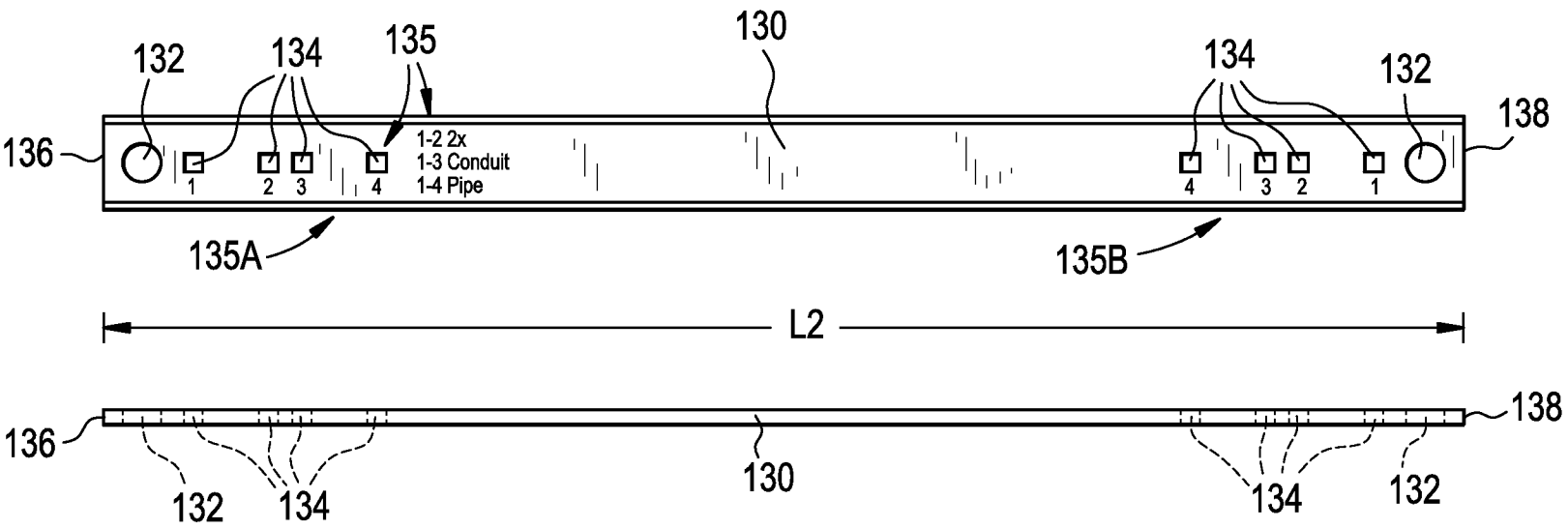
FIG. 8 is a plan view and side view of a separator bar in accordance with one embodiment of the present invention.
Figure 9:
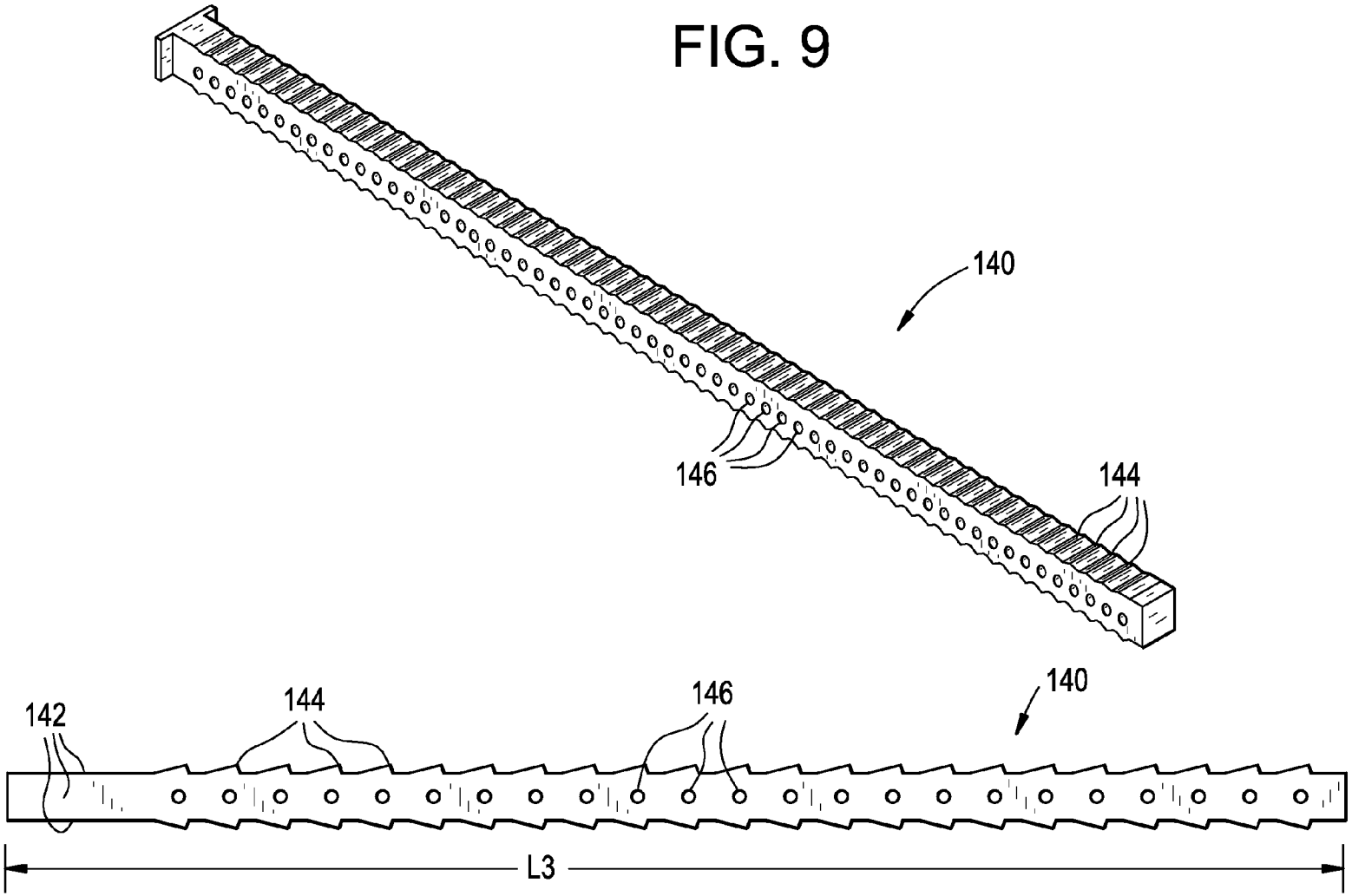
FIG. 9 is perspective view and a side view of a reinforcement post in accordance with one embodiment of the present invention.

Referring again to FIG. 2, in one embodiment, the bracket assembly 120 (e.g., each of bracket assemblies 120A and 120B) includes one or more separator bars 130 and two or more reinforcement posts 140, illustrated in greater detail at FIGS. 8 and 9, respectively. The separator bars 130 and the reinforcement posts 140 cooperate to retain the side walls 160, and components thereof, in the vertical orientation and the horizontally spaced apart (e.g., distant) relation of the predetermined configuration or portion thereof. As shown in FIGS. 1-7, the separator bars 130 and a first pair of reinforcement posts 140 cooperate to retain a portion of the first side wall 162 in the substantially vertical orientation and the horizontally distant relation from the second side wall 164 retained by the separator bars 130 and a second pair of the reinforcement posts 140.

As illustrated in FIG. 8, each of the one or more separator bars 130 include a plurality of apertures 132 and 134 disposed at predetermined locations along a length L2 of the separator bar 130. In one embodiment, the apertures 132 are disposed at opposing ends 136 and 138 of each of the separator bars 130 and are sized to receive a stake or post 158 (FIG. 1) for securing the bracket assembly 120 at a location within the excavated area 190. The apertures 134 are disposed (as described below) at predetermined locations along the length L2 of the separator bar 130 and are sized to receive the reinforcement posts 140. As illustrated in FIG. 9, in one embodiment each of the reinforcement posts 140 includes serrations 144 disposed along at least a portion of a length L3 of sides 142 of the reinforcement post 140. The plurality of apertures 134 of the separator bars 130 and the serrations 144 of the reinforcement posts 140 are sized to frictionally engage one another whereby placement of a reinforcement bar 140 within an aperture 134 provides frictional engagement between the serrations 144 and the separator bar 130 to prevent displacement. In one embodiment, the reinforcement posts 140 include apertures 146 through the sides 142 of the posts. The apertures 146 provide means whereby a length of line (e.g., a level line) can be inserted through one or more reinforcement posts 140 and additional articles (e.g., rebar, the separator bars 130) can be tethered to and/or supported by the reinforcement post 140. In one embodiment, wire, pins, fasteners may be disposed within the apertures 146 to support the separator bar 130 in a vertical orientation between the reinforcement posts 140. In one embodiment, the separator bar 130 is otherwise clamped, fastened or secured in the vertical orientation between the reinforcement posts 140. In one embodiment, the separator bar 130 may include a plurality of tabs that are selectively extendable into the apertures 134 to lock the reinforcement post 140 to the separator 130.

In one aspect of the invention, the predetermined locations of the apertures 134 of the separator bars 130 correspond to nominal widths of elongated building material required, recommended or preferred, for use as components to construct the side walls 160. For example, when a first pair of the reinforcement posts 140 are placed within corresponding ones of the apertures 134 proximate end 136 of the separator bar 130 the first side wall 162 is retained in place between the first pair of posts 140, and when a second pair of the reinforcement posts 140 are placed within corresponding ones of the apertures 134 proximate the opposing end 138 of the separator bar 130 the second side wall 164 is retained in place between the second pair of posts 140. As shown in FIG. 8, in one embodiment, the separator bar 130 is stamped, labeled or otherwise marked with indicia, shown generally at 135, to identify nominal widths of typical building materials, required, recommended or preferred, for use as components to construct the side walls 160. For example, the separator bar 130 includes such indicia 135 proximate its ends 136 and 138 to correspond to locations to construct each of the side walls. In one embodiment, a first set of indicia 135A proximate the end 136 corresponds to the location for constructing the first side wall 162 and a second set of indicia 135B proximate the end 138 corresponds to the location for constructing the second side wall 164.

During construction of the first side wall, for example, a first post 140A of the first pair of reinforcement posts 140 is placed within an aperture 134 proximate the end 136 of the separator bar 130 such that the first reinforcement post 140A is disposed externally with respect to the channel 192 (e.g., disposed at a location shown generally at 192A), and a second post 140B of the first pair of reinforcement posts 140 is placed within an aperture 134 inwardly from the end 136 such that the second reinforcement post 140B is disposed internally with respect to the channel 192 (e.g., disposed at a location shown generally at 192B) to externally and internally bound the components used to construct the first side wall 162 between the first pair of reinforcement posts 140A and 140B. Similarly, during construction of the second side wall a first post 140C of the second pair of reinforcement posts 140 is placed within an aperture 134 proximate the end 138 of the separator bar 130 such that the reinforcement post 140C is disposed externally with respect to the channel 192 (e.g., disposed at a location shown generally at 192C), and a second post 140D of the second pair of reinforcement posts 140 is placed within an aperture 134 inwardly from the end 138 such that the reinforcement post 140D is disposed internally with respect to the channel 192 (e.g., disposed at about location 192B), to externally and internally bound the components used to construct the second side wall 164 between the second pair of reinforcement posts 140C and 140D.

In one embodiment, the indicia 135 is comprised of a coding system such as, for example, a numeric coding system. For example, a first one of the apertures 134 proximate each of the ends 136 and 138 of the separator bar 130 is identified by a "1" marking and a second one of the apertures 134 disposed inwardly from the first aperture is identified by a "2" marking, where the first and second apertures are disposed at locations that correspond to a nominal width of a wooden board (e.g., stock "two-by" board materials having a nominal width of about one and one half inch (1.5 in.)); the first aperture (marked "1") and a third one of the apertures 134 inwardly from the second aperture (marked "2") is identified by a "3" marking, where the first and third apertures are disposed at locations that correspond to a nominal width of a rectangular conduit (e.g., a stock rectangular conduit having a nominal with of about two inches (2 in.)); and the first aperture (marked "1") and a fourth one of the apertures 134 inwardly from the third aperture (marked "3") is identified by a "4" marking, where the first and fourth apertures are disposed at locations that correspond to a nominal width or diameter of a round drain pipe (e.g., a stock drain pipe having a nominal diameter of about four inches (4.0 in.), six inches (6.0 in.) or other dimensions as would be required, recommended or preferred by one skilled in the art). While the present invention expressly discloses a numeric coding system for the apertures 134, it should be appreciated that it is within the scope of the present invention to employ other coding systems including, for example, a scale illustrating measurements in English (fraction or inch based), Metric (decimal based) and other measurement systems as would be used in the art. While not shown, it should be appreciated that spacers or shims may be used to increase or decrease the distance between two or more of the apertures 134 for securing building materials of nonstandard widths between corresponding pairs of reinforcement posts 140.

Figure 10A:
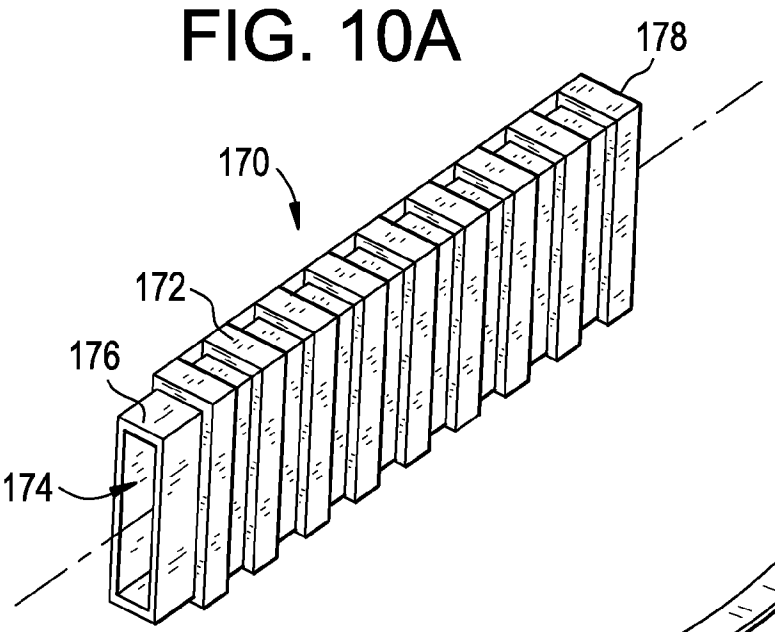
FIGS. 10A-10C illustrate components of the form system in accordance with one embodiment of the present invention.

In one embodiment, shown in FIG. 10A, a conduit 170 is illustrated for use as a component to construct the side walls 160. The conduit 170 includes a corrugated-shaped wall 172 defining an interior cavity 174. As shown in FIG. 10, in one embodiment the conduit 170 includes a male end 176 and a female end 178. The male end 176 and the female end 178 configured to permit an end-to-end coupling of a plurality of the conduits 170.

Figure 10B:
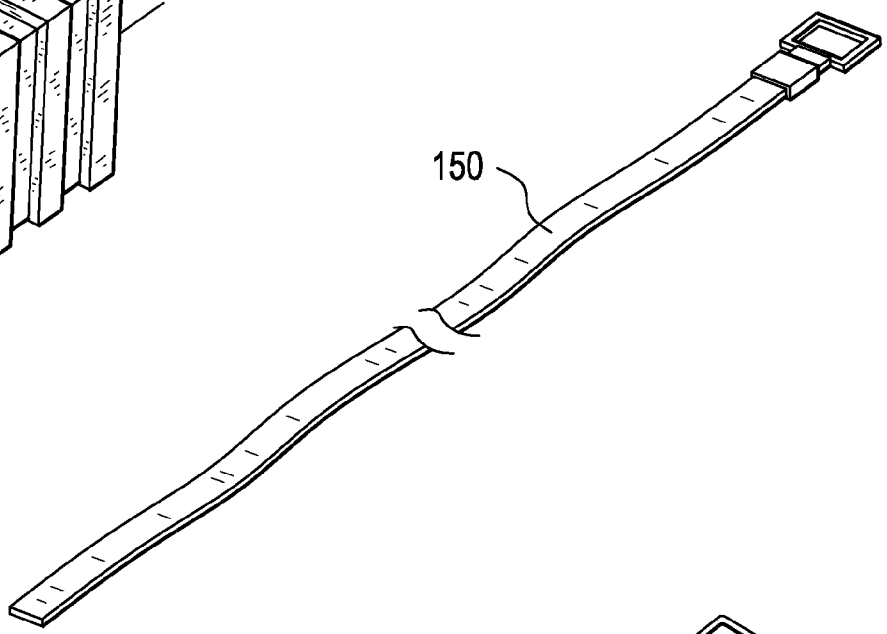
Figure 10C:
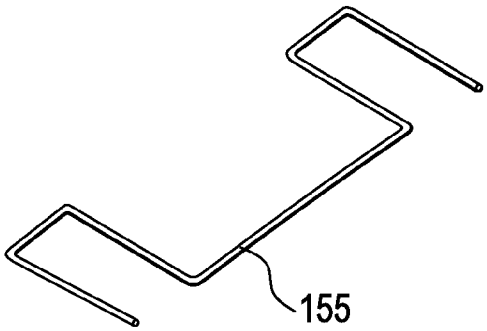
Figure 11B:
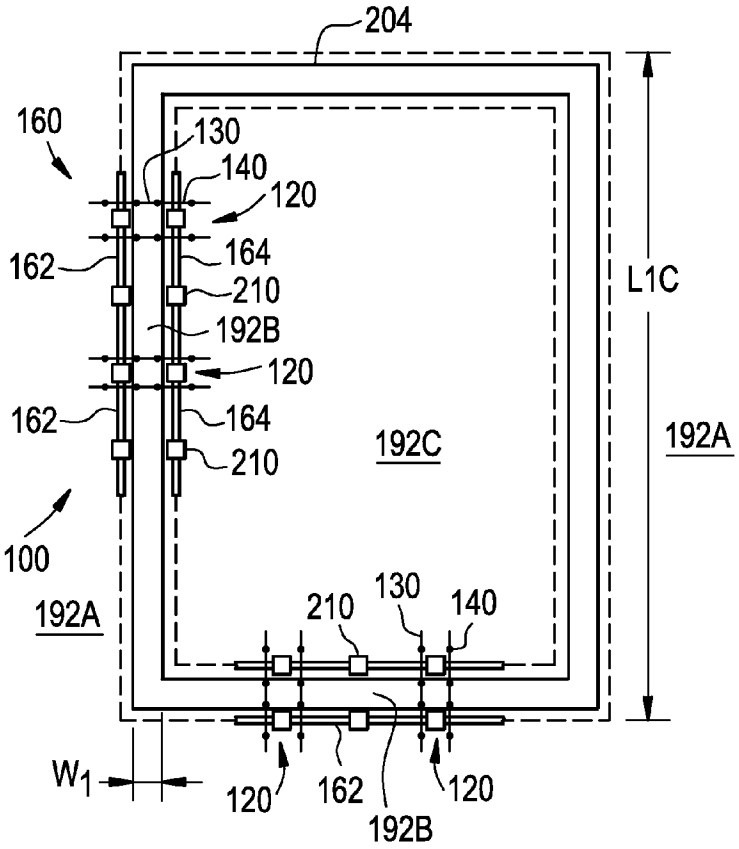
FIGS. 11A and 11B depict a use of the form system of the present invention.
Figure 11A:
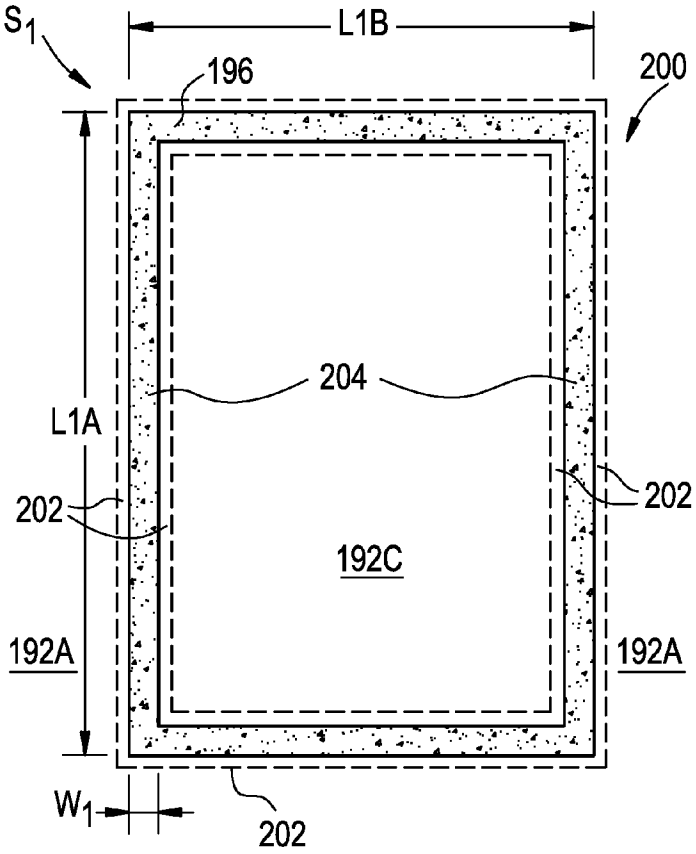

As illustrated in FIGS. 11A and 11B, the inventive form system 100 receives and retains concrete 196 being cured for use in constructing a foundation 200 including a footing 202 and walls 204 for a structure of interest such as, for example, a residential or commercial building or portion thereof. For example, a plurality of the bracket assemblies 120 may be operated to retain a plurality of the side walls 160 in the predetermined configuration, including the height H1 (extending in a plane vertically out of the drawing sheet), width W1, length L1 (including legs L1A, L1B, L1C, etc.) and shape S1 within the excavated area 190, to receive the concrete 196 to form one or both of the footing 202 and walls 204 of the foundation 200 for the structure of interest. As shown in FIG. 11B, components of the side walls 160 (e.g., sections of elongated building materials such as wooden boards, planks or sheet materials, tubular members such as round drain or drainage pipe, square or rectangular pipe or conduit, and the like) are assembled, interconnected or interlocked in end-to-end fashion by, for example, one or more connectors 210, to form walls for retaining the concrete or other building materials. As described in further detail below, when the side walls 160 are comprised of tubular, square or rectangular members having an interior cavity 166, such as pipe or conduit (as shown in FIGS. 2, 3, 6 and 7), the assembled, interconnected or interlocked side wall components are integrally formed within the structure and cooperate to define one or more passages 180 within the side walls 160 for air flow around at least an exterior (e.g., within area 192A) and interior (e.g., within area 192C) of the formed footing 202 and the walls 204. For example, the inventor has found that when assessed after construction, the one or more passages 180 of the side walls are conducive to providing ventilation for effective and efficient transfer (e.g., removal and/or remediation) of radon or other unwanted gas from the structure constructed. In one embodiment the transfer of gas may be aided by an additional volume of air flow introduced by, for example, an in-line force air system. It should be appreciated that the passage 180 may be continuous, for example, provide for air flow about substantially all of an exterior perimeter, interior perimeter or both the exterior and interior perimeter of the formed footing 202 and the walls 204. Alternatively, one or more portions of the exterior and interior perimeter of the formed footing 202 and the walls 204 may include the integrally formed side walls that provide one or more of the passage 180 that can be assessed to transfer (e.g., remove and/or remediate) radon or other unwanted gas areas (e.g., area 192A and/or area 192C) proximate the building constructed. As shown in FIGS. 10B and 10C, in one embodiment, one or both of a plurality of straps 150 and spreaders 155 may be positioned about the side walls 160 and 260 and cooperate with the bracket assembly 120 (and a bracket assembly 220 described below) to assist in retaining the components of the side walls 160 and 260 in place as the concrete is received and cures within the inventive form system 100.

Figure 12A:
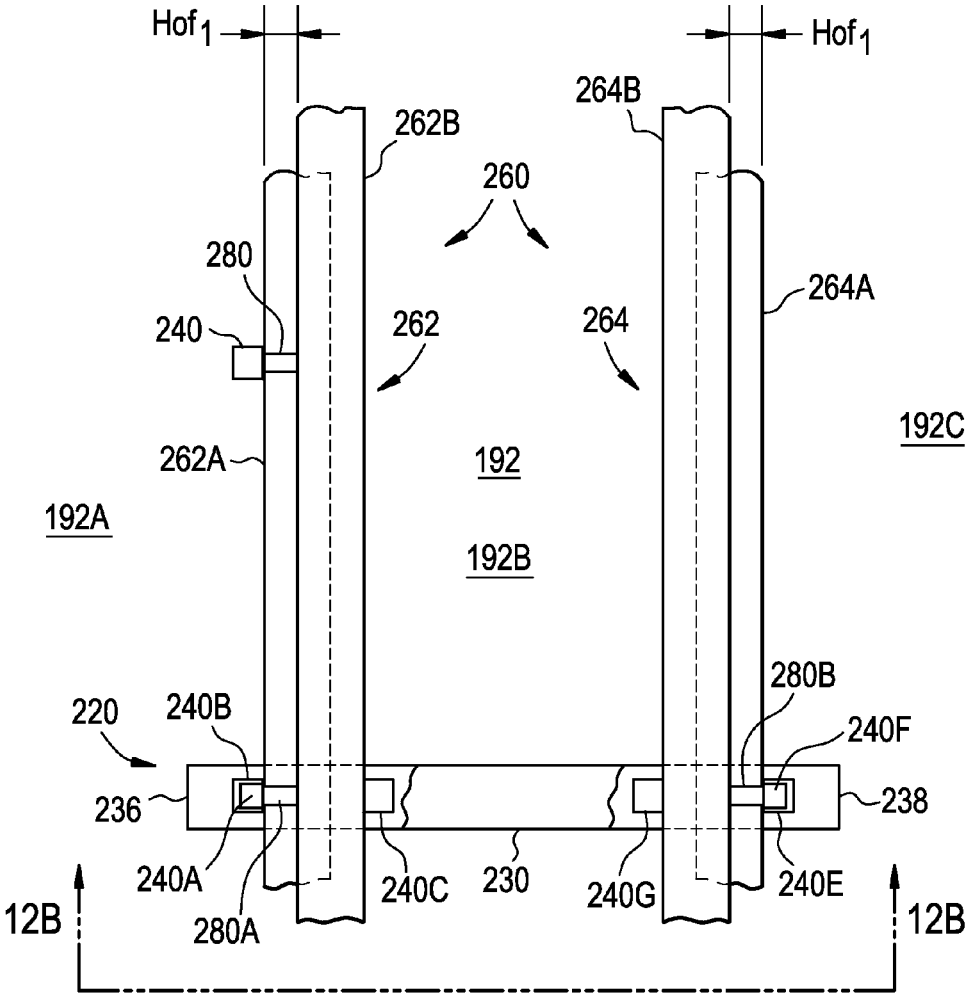
FIG. 12A is a partial plan view of components of the form system in accordance with one embodiment of the present invention.
Figure 12B:
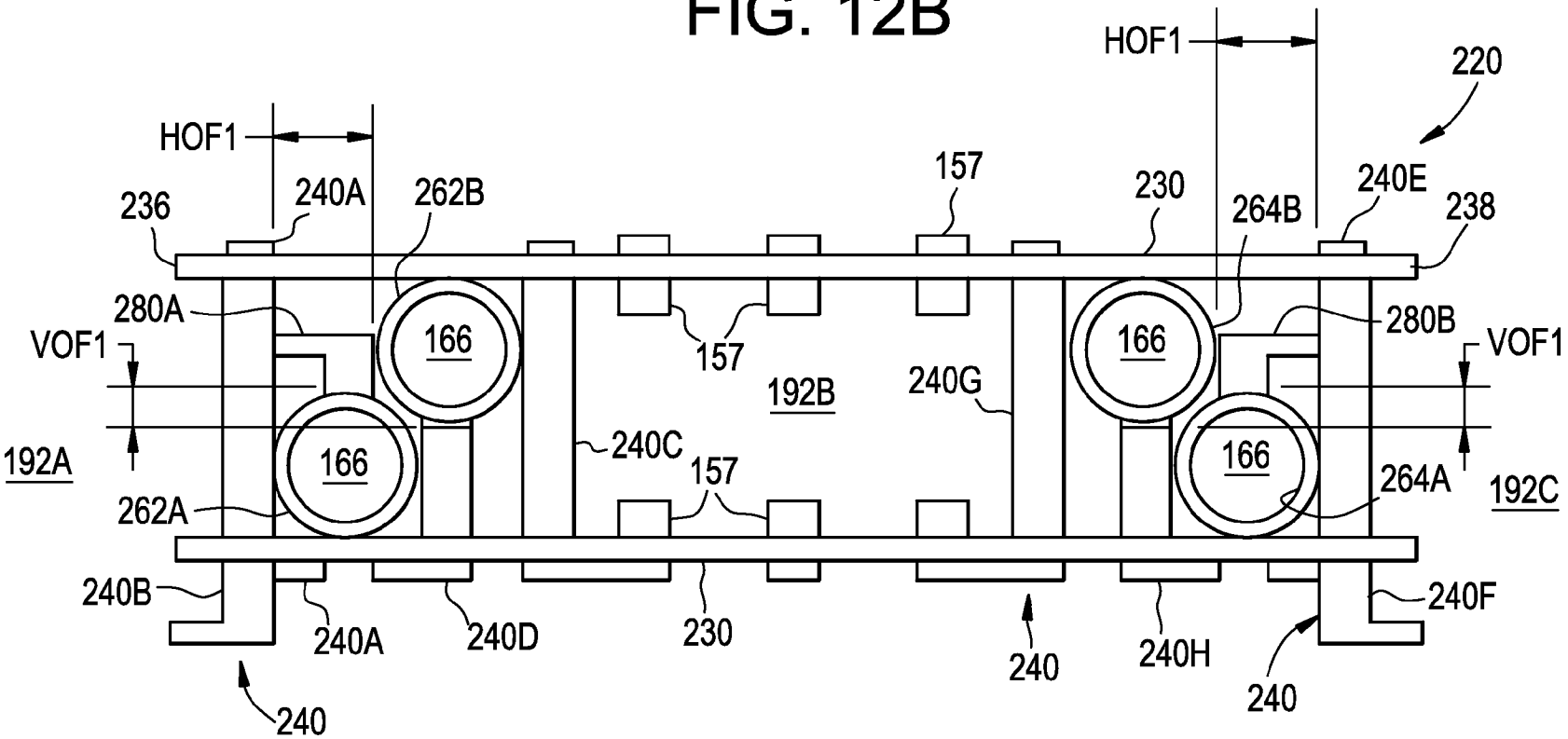
FIG. 12B is cross-sectional views of the components of FIG. 12A, taken along line 12B-12B.
Figure 13:
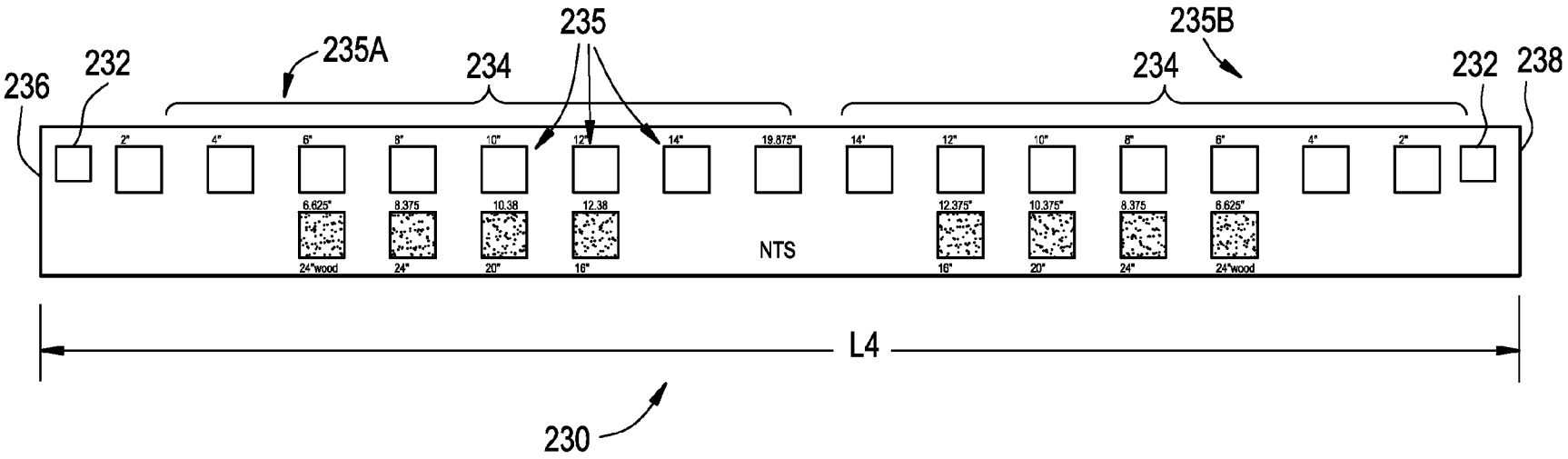
FIG. 13 is a plan view of a separator bar in accordance with one embodiment of the present invention.

Turning now to FIGS. 12A and 12B, in one embodiment the inventive form system 100 includes one or more bracket assemblies 220 disposed at varying intervals along the length L1 of the predetermined configuration within the excavated area 190 (similar to bracket assemblies 120) to keep side walls 260 from moving (e.g., being displaced) by pressure exerted thereon by the flowing concrete 190 introduced to the channel 192 formed between the side walls 260. In one embodiment, each of the one or more bracket assemblies 220 includes one or more separator bars 230 and two or more reinforcement posts 240, illustrated in greater detail at FIGS. 13, 14A and 14B, respectively. As with the separator bars 130 and the reinforcement posts 140 described above, the separator bars 230 and the reinforcement posts 240 cooperate to retain the side walls 260, and components thereof (e.g., the aforementioned single or stacked components of elongated building materials such as, for example, wooden boards, planks or sheet materials, tubular members such as round drain or drainage pipe, square or rectangular pipe or conduit, and combinations thereof), in the vertical orientations and the horizontally spaced apart (e.g., distant) relation of the predetermined configuration. As illustrated in FIG. 13, each of the one or more separator bars 230 include a plurality of apertures 232 and 234 disposed at predetermined locations along a length L4 of the separator bar 230. In one embodiment, the apertures 232 are disposed at opposing ends 236 and 238 of each of the separator bars 230 and are sized to receive the stake or post 158 (FIG. 1) for securing the bracket assembly 220 at a location within the excavated area 190. The apertures 234 are disposed (as described below) at predetermined locations along the length L4 of the separator bar 230 and are sized to receive one or more of the reinforcement posts 240. In one embodiment, the apertures 234 may be used to support structure members such as, for example, rebar supports 157.

Figure 14A:
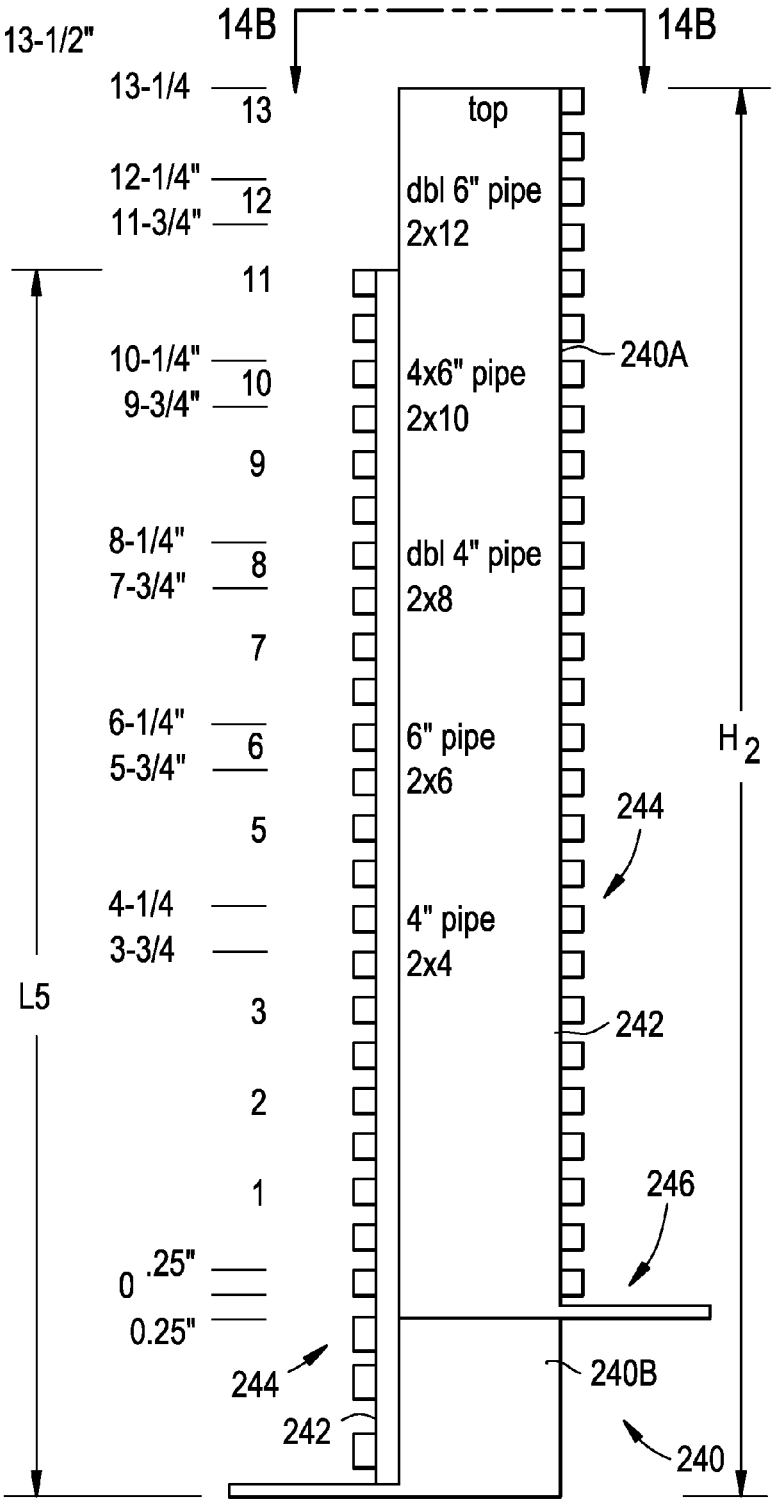
FIGS. 14A and 14B are an elevation view and a plan view of reinforcement posts in accordance with one embodiment of the present invention.
Figure 14B:
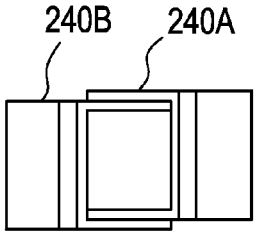

As illustrated in FIGS. 14A and 14B, in one embodiment each of the reinforcement posts 240 includes protrusions or serrations 244 disposed along at least a portion of a length L5 of one or more sides 242 of the reinforcement post 240. The sides 242 terminate at an end 246. In one embodiment, the end 246 is comprised of a foot extending outwardly from the sides 242. In one embodiment, the foot may include an aperture for receiving a stake to retain the reinforcement post 240 in position within the excavated area 190. Alternatively, the end 246 is tapered to conclude at a point or edge to retain the reinforcement post 240 in position. The plurality of apertures 234 of the separator bars 230 and the protrusions or serrations 244 of the reinforcement posts 240 are sized to frictionally engage one another whereby placement of a reinforcement bar 240 within an aperture 234 provides frictional engagement between the protrusions or serrations 244 and the separator bar 230 to prevent displacement. In one embodiment, the separator bar 230 may include a plurality of tabs that are selectively extendable into the apertures 234 to lock the reinforcement post 240 to the separator 230.

In one embodiment, the reinforcement posts 240 are comprised of U-shaped or rectangular tubular members (e.g., polymer U-channel or tubing) having a wall of a thickness to provide a relatively rigid structure (e.g., about 0.125 in thickness). In one embodiment, the reinforcement posts 240 are of uniform sizes and thus, are selectively interchangeable with and nestable within one another. For example, as shown in FIG. 14B, two posts 240A and 240B of the reinforcement posts 240 may be nested such that the reinforcement post 240A is vertically adjustable over a height H2 within the reinforcement post 240B. As can be appreciated by one skilled in the art, this vertical adjustment over the height H2 of the nested reinforcement posts 240A and 240B provides a leveling feature when the grade of at least a portion of the excavated area 190 is uneven. It should also be appreciated that nested ones of reinforcement posts 240 provide for a selectively adjustable height as needed to retain the separator bars 230 and/or components of the side walls 260 (described below) within the predetermined configuration, as the configuration is being constructed. In one embodiment, the nested reinforcement posts 240A and 240B include means for securing a relative vertical relation between them such as, for example, apertures for receiving a fastener or pin, a hook and/or ratchet arrangement, or like coupling mechanism.

In one aspect of the invention, the predetermined locations of the apertures 234 of the separator bars 230 correspond to nominal widths of elongated building material required, recommended or preferred, for use as components to construct the side walls 260 as well as widths of side walls 260 to be constructed. For example, as with the bracket assembly 120, when a first pair of the reinforcement posts 240 of the bracket assembly 220 are placed within corresponding ones of the apertures 234 proximate end 236 of the separator bar 230 a first side wall 262, and components thereof, are retained in place between the first pair of posts 240, and when a second pair of the reinforcement posts 240 are placed within corresponding ones of the apertures 234 proximate the opposing end 238 of the separator bar 230 a second side wall 264, and components thereof, are retained in place between the second pair of posts 240. Similar to the separator bar 130, as shown in FIG. 13, in one embodiment the separator bar 230 is stamped, labeled or otherwise marked with indicia, shown generally at 235, to identify nominal widths of typical building materials, required, recommended or preferred, for use as components to construct the side walls 260 and/or of the side walls 260 themselves. For example, the separator bar 230 includes such indicia 235 proximate its ends 236 and 238 to correspond to locations to construct each of the side walls 160 and 260. For example, a first set of indicia 235A proximate the end 236 corresponds to the location for constructing the first side wall 162 or the first side wall 262, and a second set of indicia 235B proximate the end 238 corresponds to the location for constructing the second side wall 164 or the second side wall 264.

In one aspect of the invention, the bracket assembly 220 permits construction of footings 202 and walls 204 of the foundation 200 having the substantially vertical side walls 162 and 164 of a generally rectangular or square cross-section, the side walls 262 and 264 of a generally trapezoidal cross-section, and/or of combinations and variations thereof such as, for example, a footing or wall having a first side wall (e.g., the walls 262) approximating a leg of a trapezoid (e.g., a trapezoidal cross-section with an angular incline of less than ninety degrees (90°)) and a second side wall (e.g., the walls 164) approximating a leg of a rectangle (e.g., a rectangular cross-section with an angular incline of ninety degrees (90°)). In one embodiment, the bracket assembly 220 includes one or more spacers 280 that mount over or are coupleable to the reinforcement posts 240 at a desired vertical location about the post 240 to permit an offset in the configuration (e.g., a horizontal offset HOF1 and a vertical offset VOF1) of one or more components used to construct the side walls 260 configured to approximate a leg of a trapezoid.

As shown in FIGS. 12A and 12B, during construction of a first side wall 262, the first reinforcement post 240A is nested within the second reinforcement post 240B and the nested posts are disposed within an aperture 234 proximate the end 236 of the separator bar 230 such that the nested reinforcement posts 240A and 240B are disposed externally with respect to the channel 192 (e.g., disposed at about location 192A). A third post 240C is then placed within an aperture 234 inwardly from the end 236 such that the third reinforcement post 240C is disposed internally with respect to the channel 192 (e.g., disposed at about location 192B) to externally and internally bound a first component 262A and a second component 262B (e.g., tubular members) used to construct the first side wall 262 between the nested, externally disposed reinforcement posts 240A and 240B and the internally disposed reinforcement post 240C. As shown in FIG. 12A, a spacer 280A is disposed over the nested, externally disposed reinforcement posts 240A and 240B and cooperates with a fourth reinforcement post 240D to maintain an offset relation between the first component 262A and the second component 262B of the first side wall 262, for example, the horizontal offset HOF1 and the vertical offset VOF1. Similarly, during construction of the second side wall 264, a fifth reinforcement post 240E is nested within a sixth reinforcement post 240F and the nested posts are disposed within an aperture 234 proximate the end 238 of the separator bar 230 such that the nested reinforcement posts 240E and 240F are disposed externally with respect to the channel 192 (e.g., disposed at about location 192C). A seventh reinforcement post 240G is then placed within an aperture 234 inwardly from the end 238 such that the seventh reinforcement post 240G is disposed internally with respect to the channel 192 (e.g., disposed at about location 192B) to inwardly bound a first component 264A and a second component 264B (e.g., tubular members) used to construct the second side wall 264 between the nested, externally disposed reinforcement posts 240E and 240F and the internally disposed reinforcement post 240G. As shown in FIG. 12A, a spacer 280B is disposed over the nested, externally disposed reinforcement posts 240E and 240F and cooperates with an eighth reinforcement post 240H to maintain an offset relation between the first component 264A and the second component 264B of the second side wall 264, for example, the horizontal offset HOF1 and the vertical offset VOF1. One skilled in the art, when viewing FIGS. 12A and 12B, would appreciate that the illustrated configuration of the bracket assembly 220 permits construction of side walls 262 and 264 forming a footing or foundation having generally trapezoidal cross-section.

Figure 12C:
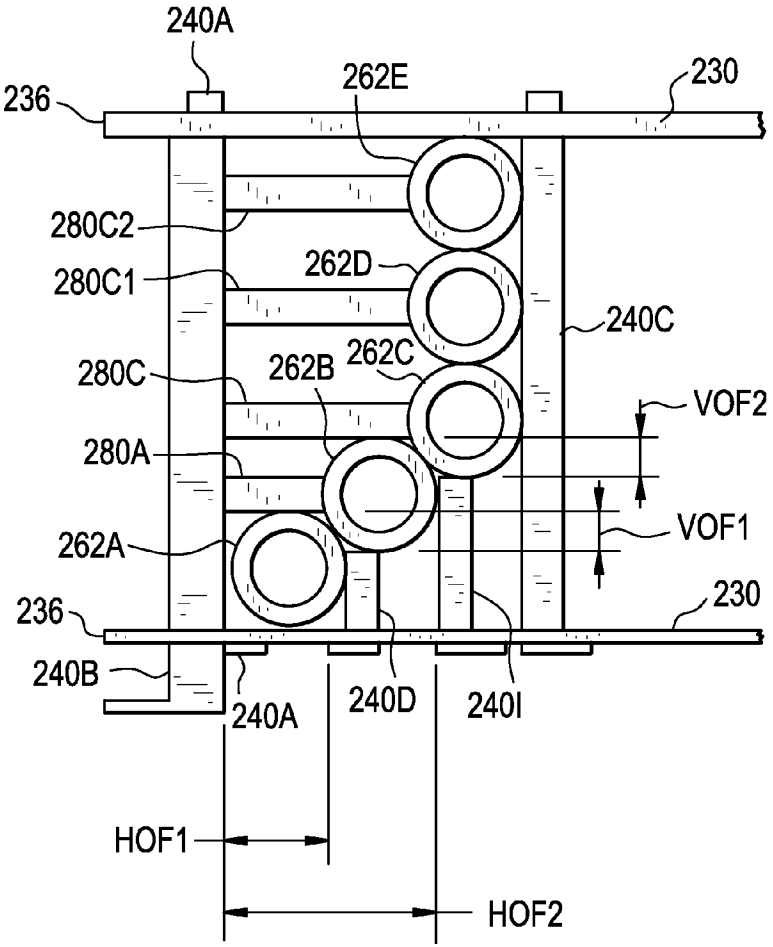
FIG. 12C is partial cross-sectional views of the components of FIG. 12A in accordance with one embodiment of the invention.

It should be appreciated that a plurality of spacers 280 having varying lengths (distance as measured from its coupling with a reinforcement post) and a plurality of reinforcement posts 240 having varying heights may be employed to form footings and/or walls of a predetermined height and a generally trapezoidal cross-section over at least a portion of the predetermined height. For example, as shown in FIG. 12C, a partial cross-sectional view, a spacer 280C is disposed over the nested, externally disposed reinforcement posts 240A and 240B and cooperates with a ninth reinforcement post 240I to maintain an offset relation between the first component 262A, the second component 262B and a third component 262C of the first side wall 262, for example, the horizontal offset HOF1 and the vertical offset VOF1 between the first component 262A and the second component 262B, and a horizontal offset HOF2 between the first component 262A and the third component 262C and a vertical offset VOF2 between the second component 262B and the third component 262C. In one embodiment, a plurality of spacers of similarly length as the spacer 280C (e.g., spacers 280C1 and 280C2) may be employed to maintain a common offset as fourth and fifth components 262D and 262E are added to increase the height of the first side wall 262. Accordingly, the first side wall 262 of FIG. 12C includes a lower portion having a generally trapezoidal cross-section, and an upper portion having a generally rectangular cross-section.

While FIGS. 12A-12C illustrate for clarity, relatively similar vertical and horizontal offsets (e.g., HOF1, HOF2, VOF1, VOF2) between components (e.g., 262A, 262B, 262C, 264A, 264B, 264C) of the side walls 260, it is within the scope of the present invention to vary one or more such offsets as may be required, recommend or preferred to achieve side walls of various configurations. As such, the recited offset relation between components of the side walls 260 should be considered broadly to include various horizontal and vertical spacing of the components of the side walls 260. For example, while not illustrated in FIGS. 12A-12C, it is also within the scope of the present invention to dispose one or more of the spacers 280 over one or more of the internally positioned (with respect to the channel 192) reinforcement posts 240 such as, for example, the reinforcement post 240C, that inwardly bounds the components of the side wall 260 (e.g., the second component 262B). In one embodiment the spacers 280 may both internally and externally offset the components such that a cross section of the side walls 260 is configured to approximate a ribbed or corrugated side wall.

It should also be appreciated that as the height H1 of the side walls 162, 164, 262 and 264 increases two or more of the bracket assemblies 120 and 220 may be stacked and coupled together. For example, apertures 134 and 234 may be used to receive posts or ties for coupling two or more stacked bracket assemblies 120 and 220. In addition, one or more of the reinforcement posts 140 and 240 may be coupled, interconnected or nested, to support the stacked arrangement.

As noted above, the inventive form system 100 may be used to construct the foundation 200 including one or both of the footing 202 and the walls 204 for the structure of interest. For example, a plurality of the bracket assemblies 120 and 220 may be operated to retain a plurality of the side walls 160 and 260, and components thereof, in the predetermined configuration to receive the concrete 196 to form one or both of the footing 202 and walls 204 of the foundation 200 for the structure of interest. When the components used to construct the side walls 160 and 260 are comprised of tubular, square or rectangular members having the interior cavity 166 and 174, the interior cavities 166 and 174 of the interconnected components cooperate to define one or more of the passages 180 within the side walls 160 and 260 for air flow around at least a portion of an exterior perimeter (e.g., within area 192A) and/or interior perimeter (e.g., within area 192C) of the formed footing 202 and the walls 204. The inventor has found that when assessed after construction, the one or more passages 180 are conducive to providing ventilation for effective and efficient transfer (e.g., removal and/or remediation) of radon or other unwanted gas from exterior or interior portions of the structure constructed.

Figure 15A:
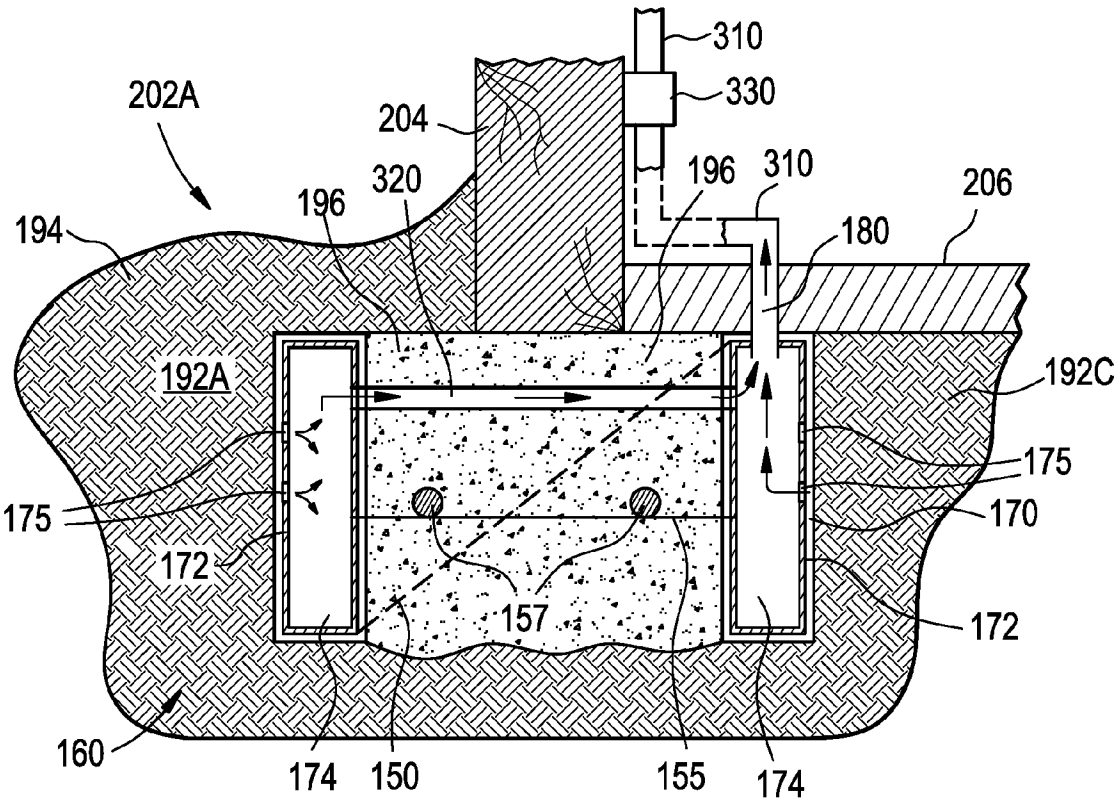
FIGS. 15A and 15B are partial cross-sectional views of the form system in use.
Figure 15B:
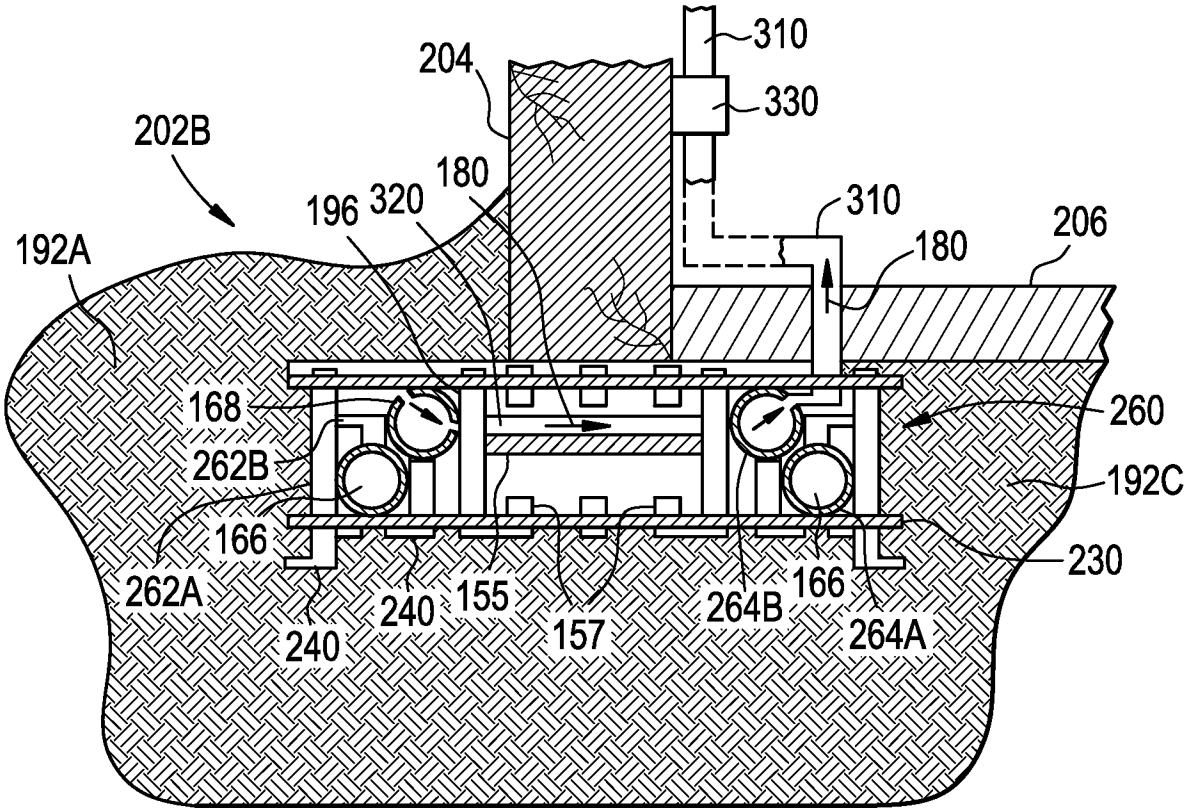

As shown in FIGS. 15A and 15B, sectional views of embodiments of the inventive form 100 are illustrated for use in forming elements of the foundation 200, namely, a footing 202A having a generally rectangular cross-section and a footing 202B having a generally trapezoidal cross-section. The side walls 160 of the footing 202A are formed of the spaced apart conduits 170 having the corrugated walls 172 and the interior cavity 174, and the side walls 260 of the footing 202B are formed of the stacked, offset conduits (e.g., components 162A, 162B, 164A, 164B, 262A, 262B, 264A and 264B) having the interior cavity 166. One or more of the plurality of straps 150 and spreaders 155 are disposed about the side walls 160 and 260 to prevent a spreading apart of connected conduits as the concrete 196 is being poured. Once the concrete 196 cures, the straps 150 and the spreaders 155 also assist in maintaining the integrally formed footing 202 and, components thereof, in position. For example, once cured, the straps 150 and the spreader 155 can be used in a permanent installation for example, to support rebar supports 157 placed in the channel 192 prior to pouring the cement. As noted above, the interior cavity 174 of interconnected conduits 170 and the interior cavity 166 of the interconnected components 262A, 262B, 264A and 264B cooperate to provide the passage 180 for air flow around the interior and exterior of the footings 202 when the passage is accessed by means of, for example, another pipe or other conduit 310 either exteriorly or interiorly (e.g., through a floor or slab 206) after the structure has been completed and unacceptable levels of radon or other gases are detected to vent the radon laden air or other unwanted gas into the atmosphere. In one embodiment, one or both of the conduit 170 and components 262A, 262B, 264A and 264B include means for receiving gases from the soil 194 within the areas 192A and 192C external and internal to footing 202 and under the slab 206. For example, the corrugated walls 172 of the conduit 170 include apertures or slots 175 to receive gases permeating from soil 194 within the areas 192A and 192C external and internal to footing 202 and under the slab 206. Similarly, one or more of the stacked components 262A, 262B, 264A, 264B include apertures or slots 168 to receive the gases permeating from the soil 194 within the areas 192A and 192C proximate the footing 202 and under the slab 206.

As shown in FIGS. 15A and 15B, one or more cross-venting pipes or conduits 320 may be installed during construction communicating between the two corrugated conduits 170 and/or components 262A, 262B, 264A, 264B of the footing 202 to provide air flow communication between the corresponding conduits 170 and/or components 262A, 262B, 264A, 264B to facilitate venting and/or removal of gases. In one embodiment, an in-line force air system 330 is coupled to the pipe 310 to increase the volume of air flow within the passage 180 and facilitate remediation of the unwanted gases.

As described herein, the present invention provides a concrete forming system for building foundations, and portions thereof, wherein walls of the foundation are constructed using building material sections that interlock end-to-end to form a passage (e.g., the passage 180). The passage is conducive to provide ventilation for effective and efficient radon or other unwanted gas remediation from the structure being constructed. The inventive forming system permits construction of footings and walls of the foundation that may have substantially vertical side walls of a generally rectangular or square cross-section, side walls of a generally trapezoidal cross-section, and/or combinations and variations thereof. The inventor has recognize that the forming system permits construction of, for example, a sub-slab depressurization system with a minimum of about fifty percent (50%) more mitigation than is seen with prior art systems.

In one aspect of the present invention, when installing footing forms that need to be leveled, the present invention (e.g., the bracket assembly 220) provides a relatively easy leveling feature to minimize labor needed to level the form prior to use.

In yet another aspect of the present invention, once concrete has cured, there is no need to remove components of the forms as the components are integrally formed within the footings or walls to provide additional structural support. In one embodiment, self-leveling reinforcement posts act as a vertical brace if material is needed to block concrete from flowing out from under form.

In yet another aspect, components of the inventive form system are vertically stackable and horizontally expandable to accommodate footings and/or walls of various heights and widths.

Some perceived benefits of constructing footings and/or walls having a trapezoidal cross section include, for example:

A. Increases bearing with standard footing sizes.

B. Decrease amount of material used with standard footing sizes.

C. The standard footing sizes are reduced, but a same bearing is achieved.

D. Decreasing amount of material in reduced size achieving same bearing.

For example, a typical rectangular footing of dimensions of about twenty four inches (24 in.) in width, twelve inches (12 in.) in height and ten feet (10 ft.) in length provides a cubic volume of twenty cubic feet (20 cu. ft.), while a trapezoidal footing may be constructed to carry the same bearing by have dimensions of about sixteen inches (16 in.) in upper width and twenty four inches (24 in.) in lower width, twelve inches (12 in.) in height and ten feet (10 ft.) in length provides a cubic volume of sixteen cubic feet (16 cu. ft.).

The terms "first," "second," and the like, herein do not denote any order, quantity, or importance, but rather are used to distinguish one element from another. In addition, the terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure, that numerous variations and alterations to the disclosed embodiments will fall within the spirit and scope of this invention and of the appended claims.

What is claimed is:

1. A system for retaining a flowable and curable building material to form a portion of a foundation of at least a portion of a structure of interest, the system comprising:

side walls receiving and retaining the building material in a channel bound by the side walls, the side walls disposed in a predetermined configuration suitable for the portion of the foundation, the side walls including a first side wall and a second side wall, at least one of the first side wall and the second side wall defines an interior cavity therein;

a venting conduit disposed within the structure of interest and coupled to the interior cavity to form a first passage; and a bracket assembly retaining the side walls in the predetermined configuration, the bracket assembly including:

two or more reinforcement posts; and a separator bar having a first end, a second end opposed from the first end, and a plurality of apertures disposed along a length of the separator bar, the plurality of apertures including a first set of apertures disposed proximate the first end and a second set of apertures disposed proximate the second end, the first set apertures and the second set of apertures are sized to receive and retain a pair of the reinforcement posts at locations to establish a width of the first side wall, a width of the second side wall and a width of the channel being formed therebetween.

2. The system of claim 1, wherein the first side wall is disposed on an external side of the channel and the second side wall is disposed on an internal side of the channel, the interior cavity further comprising:

a first interior cavity defined in the first side wall; and a second interior cavity defined in the second side wall.

3. The system of claim 2, further comprising:

a cross-venting conduit coupling the first interior cavity of the first side wall and the second interior cavity of the second side wall to form a second passage between the first side wall and the second side wall, the second passage in communication with the first passage.

4. The system of claim 1, further including a plurality of connectors for interconnecting the first side wall and the second side wall to a next first side wall and a next second side wall in an end-to-end manner over a length of the predetermined configuration for the portion of the foundation.

5. The system of claim 1, wherein the at least one of the first side wall and the second side wall having the interior cavity therein includes an aperture to receive gas permeating from soil disposed around the portion of the foundation into the first passage.

6. The system of claim 1, further including an in-line forced air system coupled to the venting conduit to increase a volume of air flow within the first passage.

7. The system of claim 1, wherein the two or more reinforcement posts are comprised of two nested rectangular tubular members that are vertically adjustable over a height of each of the reinforcement posts to provide a leveling feature when at least a portion of the channel is formed over an uneven grade.

8. The system of claim 1, wherein the separator bar further includes indicia proximate the first set of apertures and the second set of apertures, the indicia identifying nominal widths of the building materials used as the components of the side walls.

9. The system of claim 1, further including one or more straps disposed about the side walls to prevent a spreading apart of the side walls and an increase in the width of the channel bound by the side walls.

10. The system of claim 1, further including a spreader disposed about and between the side walls to prevent a spreading apart of the side walls and an increase in the width of the channel bound by the side walls.

11. A system for retaining a flowable and curable building material to form a portion of a foundation of at least a portion of a structure of interest, the system comprising:

side walls receiving and retaining the building material in a channel bound by the side walls, the side walls disposed in a predetermined configuration suitable for the portion of the foundation, the side walls including a first side wall and a second side wall, at least one of the first side wall and the second side wall is comprised of two or more stacked components, at least one of the stacked components having an interior cavity that traverses the component;

a venting conduit disposed within the structure of interest and coupled to the interior cavity of the at least one of the components to form a first passage; and a bracket assembly retaining the side walls in the predetermined configuration, the bracket assembly including:

two or more reinforcement posts; and a separator bar having a first end, a second end opposed from the first end, and a plurality of apertures disposed along a length of the separator bar, the plurality of apertures including a first set of apertures disposed proximate the first end and a second set of apertures disposed proximate the second end, the first set apertures and the second set of apertures are sized to receive and retain a pair of the reinforcement posts at locations to establish a width of the components of the first side wall, a width of the components of the second side wall and a width of the channel being formed therebetween.

12. The system of claim 11, wherein the first side wall is disposed on an external side of the channel and the second side wall is disposed on an internal side of the channel, and wherein the two or more stacked components of the at least one of the first side wall and the second side wall further comprise:

two or more stacked first components forming the first side wall, at least one of the stacked first components having a first interior cavity that traverses the first component; and two or more stacked second components forming the second side wall, at least one of the stacked second components having a second interior cavity that traverses the second component.

13. The system of claim 12, further comprising:

a cross-venting conduit coupling the first interior cavity of the first side wall and the second interior cavity of the second side wall to form a second passage between the first side wall and the second side wall, the second passage in communication with the first passage.

14. The system of claim 11, further including a plurality of connectors for interconnecting the components of the first side wall and the components of the second side wall to components of a next first side wall and a next second side wall in an end-to-end manner over a length of the predetermined configuration for the portion of the foundation.

15. The system of claim 11, wherein the at least one component of the first side wall and the second side wall having the interior cavity therein includes an aperture to receive gas permeating from soil disposed around the portion of the foundation into the first passage.

16. The system of claim 11, further including an in-line forced air system coupled to the venting conduit to increase a volume of air flow within the first passage.

17. The system of claim 11, wherein the two or more reinforcement posts are comprised of two nested rectangular tubular members that are vertically adjustable over a height of each of the reinforcement posts to provide a leveling feature when at least a portion of the channel is formed over an uneven grade.

18. The system of claim 11, further including one or more straps disposed about the side walls to prevent a spreading apart of the side walls and an increase in the width of the channel bound by the side walls.

19. The system of claim 11, further including a spreader disposed about and between the side walls to prevent a spreading apart of the side walls and an increase in the width of the channel bound by the side walls.

20. The system of claim 11, wherein the separator bar and reinforcement posts are configured to vertically offset the two or more stacked components of the at least one of the first side wall and the second side wall such that a cross section of the channel being formed approximates at least one of a trapezoid shape or a combined trapezoid shape and rectangular shape.

* * * * *